United States Patent [19]

Bous

[11] 4,380,158

[45] Apr. 19, 1983

[54] DEVICE FOR SPACE-DYEING TEXTILE FILAMENTS

[75] Inventor: Karl Bous, Wuppertal, Fed. Rep. of Germany

[73] Assignee: Hacoba Textilmaschinen GmbH & Co. KG, Wuppertal, Fed. Rep. of Germany

[21] Appl. No.: 194,896

[22] Filed: Oct. 7, 1980

[30] Foreign Application Priority Data

Oct. 8, 1979 [DE] Fed. Rep. of Germany ..... 2940774

[51] Int. Cl.[3] ..... D06B 1/02

[52] U.S. Cl. ..... 68/205 R; 118/DIG. 21; 118/301; 118/325; 118/326

[58] Field of Search ..... 68/200, 205 R; 118/DIG. 21, 301, 325, 326; 239/120, 124, 223, 224, 380

[56] References Cited

U.S. PATENT DOCUMENTS

| | | | |
|---|---|---|---|
| 2,391,096 | 12/1945 | Knight | 68/205 R X |
| 2,672,842 | 3/1954 | Winters et al. | 118/301 X |
| 3,749,313 | 7/1973 | Weitmann | 68/205 R X |
| 4,005,590 | 2/1977 | McLean | 68/205 R X |

FOREIGN PATENT DOCUMENTS

| | | | |
|---|---|---|---|
| 222719 | 8/1962 | Austria | 118/301 |
| 2308543 | 8/1974 | Fed. Rep. of Germany | 118/325 |
| 142915 | 11/1953 | Sweden | 118/DIG. 21 |
| 1904 | of 1873 | United Kingdom | 68/205 R |

*Primary Examiner*—Philip R. Coe
*Attorney, Agent, or Firm*—Karl F. Ross

[57] ABSTRACT

A yarn to be dyed at intermittent locations is continuously transported at high speed and in stretched condition past a nozzle supplied with dyestuff under pressure, with interposition of one or more rotary shutters such as disks with arrays of apertures of various configurations centered on the axis of rotation. Synchronization between yarn motion and shutter rotation may be achieved by designing the shutter as a grooved pulley or sheave with a frustoconical recess having apertures near the groove bottom through which a yarn entraining the pulley or entrained by it can be sprayed by a nozzle lodged in the recess.

10 Claims, 9 Drawing Figures

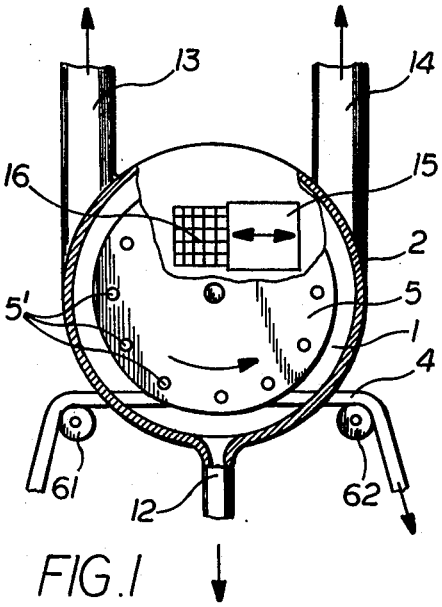
FIG.1
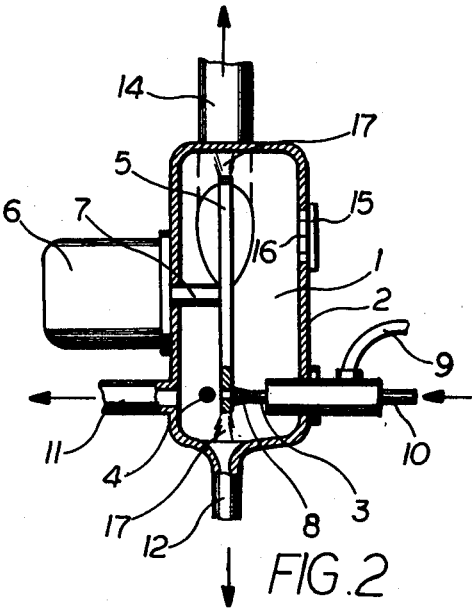
FIG.2
FIG.3
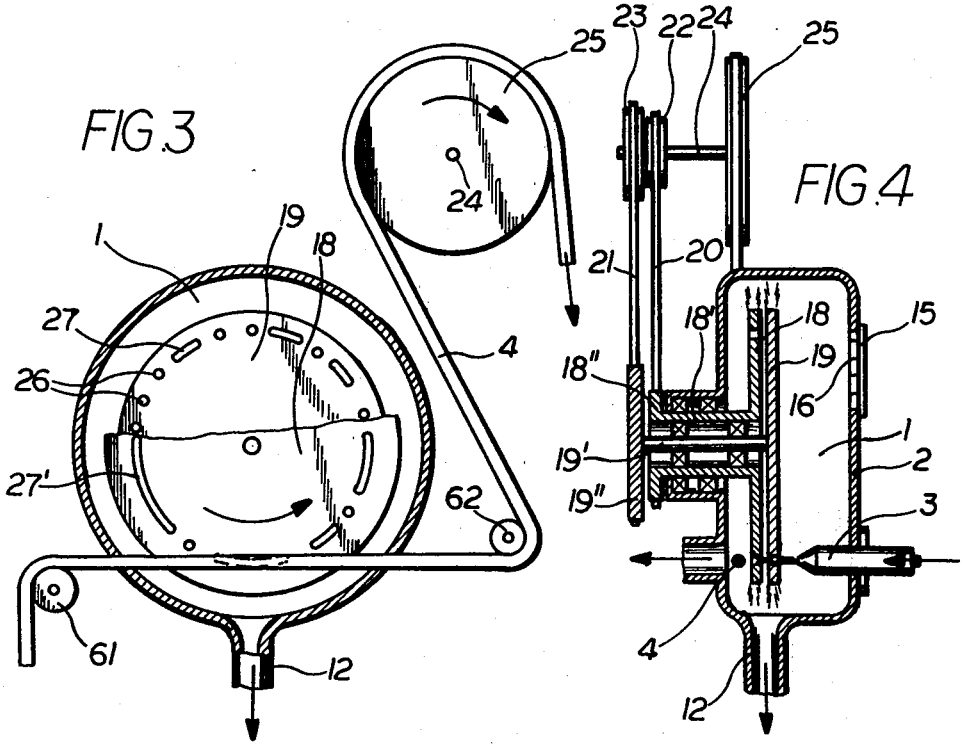
FIG.4

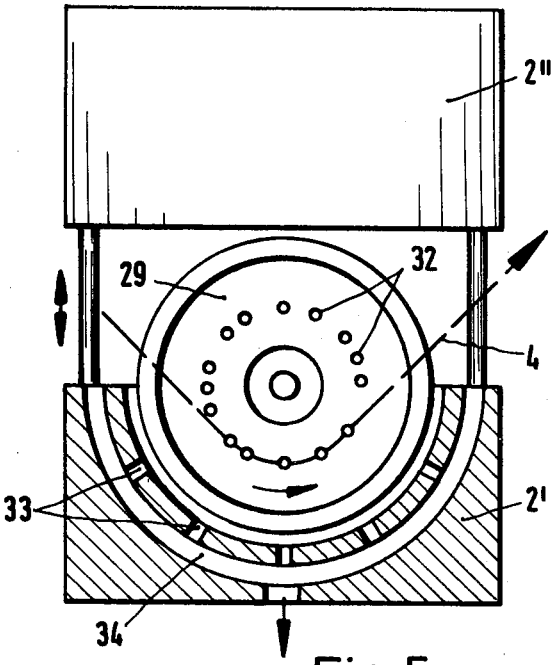
Fig. 5
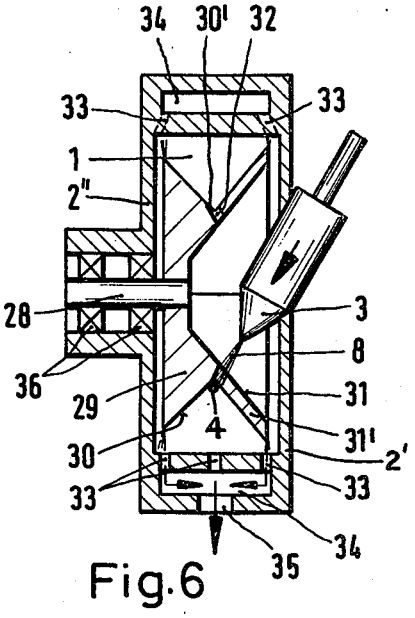
Fig. 6
Fig. 7
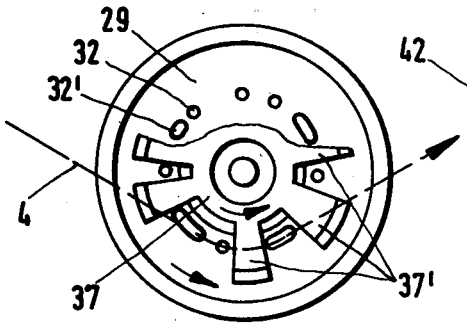
Fig. 8
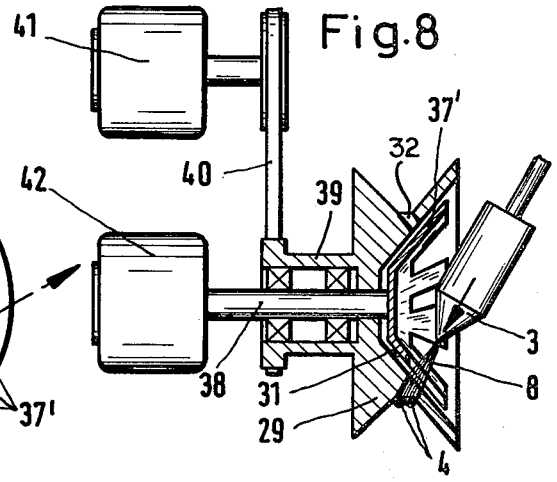

DEVICE FOR SPACE-DYEING TEXTILE FILAMENTS

FIELD OF THE INVENTION

My present invention relates to a device for dyeing filamentary material, such as textile yarn, at intermittent locations in one or more colors according to a technique known in the art as "space-dyeing".

BACKGROUND OF THE INVENTION

In my German open application (Offenlegungsschrift) No. 2,554,132, published 16 June 1977, I have disclosed a device of this type in which a spray nozzle trained upon a stretched yarn, advancing continuously at high speed, is supplied with liquid dyestuff through two cascaded valves which are opened and closed at staggered intervals to emit short spurts of the dyestuff. A drawback of this device is the relative complexity of its valve-control system.

Another system, described in German open application (Offenlegungsschrift) No. 2,320,215 published 7 Nov. 1974, teaches the use of transversely shiftable nozzle carriers for a similar purpose. Such an arrangement facilitates color changes but only at a relatively slow rate.

A method known as Eastern Color Yarn-Dyeing Process, described for example in the German publication Färberei/Druckerei/Ausrüstung, Vol. 3/1975, p. 237, utilizes a dyestuff jet trained upon a rotating disk whose frustoconical periphery scatters the impinging liquid into droplets reflected onto the yarn moving past. Such a system does not enable the production of reproducible coloration patterns and uses considerable amounts of colorant.

OBJECT OF THE INVENTION

The object of my present invention, therefore, is to provide an improved device for the purpose set forth which is of simple construction yet enables the production of very short, distinctively colored sections of filamentary material with relatively small consumption of dyestuff.

SUMMARY OF THE INVENTION

I realize this object, in accordance with my present invention, by the provision of rotary shutter means interposed between a spray nozzle and the path of a filament to be intermittently dyed, the device further comprising transport means preferably synchronized with the shutter means for conveying the filament along this path past the nozzle and thus across a jet of dyestuff chopped by the shutter means in a recurrent pulse pattern of predetermined configuration.

The shutter means may comprise a single member or several members of circular outline coaxial with one another. Such a member may be a disk with an array of apertures, not necessarily equispaced or of the same size, centered on its axis of rotation. Other possible configurations include a wheel with radially projecting, peripherally spaced sectoral teeth or vanes, planar or dished, and a sheave or pulley with a peripheral V-groove having a wall with apertures close to the groove bottom on an orbit intersected by the nozzle axis so that dyestuff can be sprayed through them onto a filament occupying part of that groove. In the latter instance the shutter motion is automatically synchronized with the advance of the filament whose transport means then include a motor coupled with the shaft of the sheave; it is, however, also possible to let the transport means entrain the sheave through the filament. In either case, another shutter member coaxially juxtaposed with the sheave but rotating at a different speed—in the same or the opposite direction—may modify the color pattern determined by the apertured groove wall.

BRIEF DESCRIPTION OF THE DRAWING

The above and other features of my invention will now be described in detail with reference to accompanying drawing in which:

FIG. 1 is a front-elevational view, partly in section, of a device embodying my invention;

FIG. 2 is a part-sectional side view of the device shown in FIG. 1;

FIG. 3 is a view similar to FIG. 1, with parts broken away, showing another embodiment;

FIG. 4 is a cross-sectional view of the device shown in FIG. 3;

FIG. 5 is another front view, partly in section, of a further embodiment;

FIG. 6 is a cross-sectional view of the embodiment shown in FIG. 5;

FIG. 7 is a rear view (parts broken away) of a shutter assembly included in still another embodiment;

FIG. 8 is a side view of the latter embodiment with the shutter assembly of FIG. 7 shown in cross-section.

SPECIFIC DESCRIPTION

Figure 9:
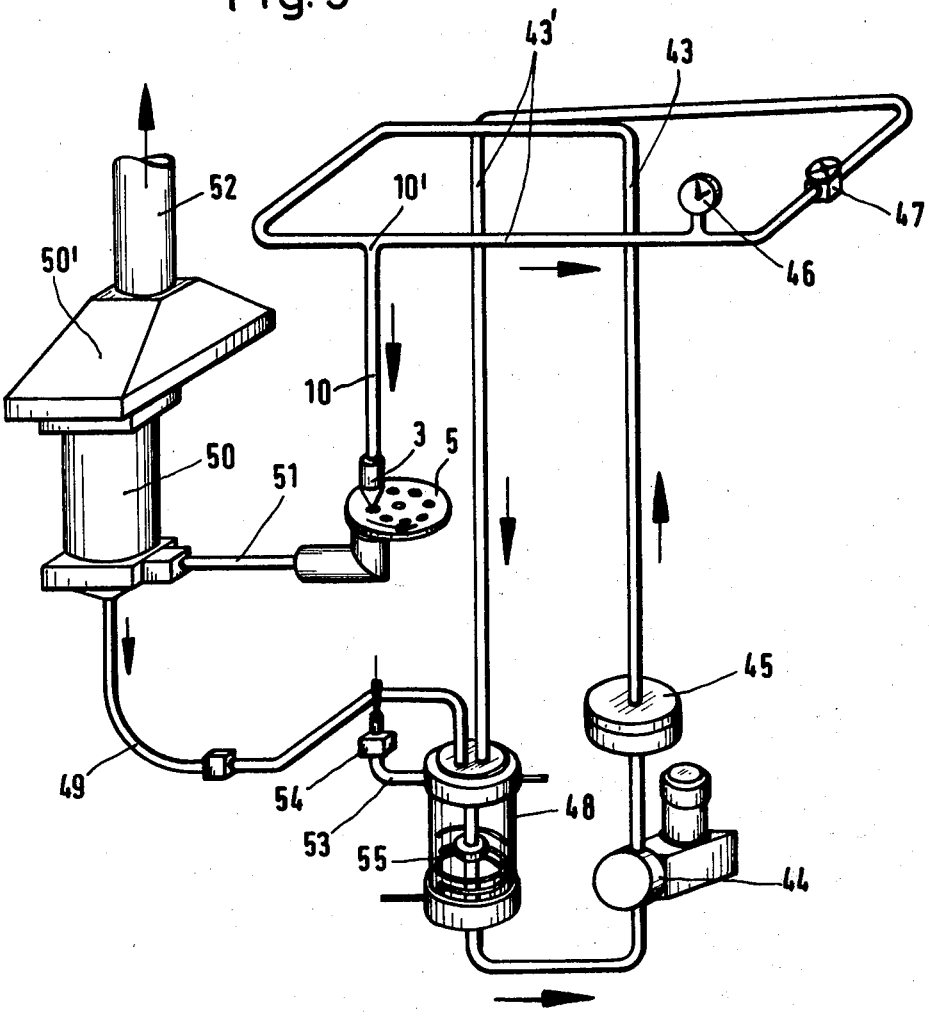
FIG. 9 is diagrammatic perspective view of a dyestuff-circulation system usable with any of the foregoing embodiments.

In FIGS. 1 and 2 I have shown a space-dyeing device comprising a treatment chamber 1 within a housing 2 whose front wall is penetrated by a spray nozzle 3 connected to a nonillustrated supply of liquid dyestuff under pressure.

A yarn 4 to be intermittently dyed is drawn past the nozzle outlet by a transport mechanism including guide rollers 61, 62.

A shutter disk 5 with an array of peripheral apertures 5' is interposed between nozzle 3 and the path of yarn 4 so as to chop a jet 8 issuing from the nozzle when the disk is rotated about its axis by the shaft 7 of a motor 6 attached to the rear housing wall. The spray may be cut off by a valve inside nozzle 3 controlled via a cable 9. The inlet for the dyestuff is shown at 10.

With the yarn 4 moving under tension at a speed of, say, 600 to 1200 meters per minute, the dyestuff penetrating the apertures 5' stains it at selected locations which in this instance are equispaced but which could be distributed according to any selected pattern recurring with every disk revolution.

A nonillustrated coupling between the drive motor 6 and the yarn transport may synchronize the advance of the yarn with the rotary speed of the disk.

Housing 2 is provided with several outlets 11–14, the last three of which lie in the plane of disk 5. Outlet 11 is in line with nozzle 3 and may be provided with a suction pump for the exhaustion of droplets missing the disk 5, whereas outlet 12 serves as a drain for excess liquid 17 accumulating at the housing bottom.

Outlets 13 and 14 may also be connected to a suction pump designed to exhaust the mist formed in the upper part of the housing whose front wall is shown provided with a vent 16 which can be closed to a greater or lesser extent by a slider 15. Thus, the atmosphere in the chamber 1 can be readily controlled.

The device shown in FIGS. 3 and 4 is similar to the preceding embodiment but uses two coaxial disks 18 and 19 inside chamber 1, these disks being provided with different arrays of perforations including bores 26 and slots 27 in the case of disk 19 and slots 27' in the case of disk 18. Dyestuff from jet 3 can reach the yarn 4 only during instants of temporary alignment of these two sets of perforations as the disks are rotated at different speeds but with a predetermined relative velocity.

The disk drive comprises in this instance a pulley 18'' secured to the hollow shaft 18' of disk 18 and another, larger pulley 19'' on the shaft 19' of disk 19.

Driven pulleys 18'' and 19'' are linked respective belts 20 and 21 to a pair of driving pulleys 22 and 23 on a shaft 24 carrying a sheave 25 which is driven by a nonillustrated motor and forms part of the yarn transport by entraining the filament 4. Precise synchronism between the shutter rotation and the yarn movement is thereby insured.

In FIGS 5 and 6 I have shown a treatment chamber 1 formed by a two-part housing whose upper half 2'' is separable from its lower half 2' to give access to its interior.

The shutter in this embodiment is a sheave 29 cantilevered on a shaft 28 which is journaled in bearings 36 of the rear housing wall. Sheave 29 has a peripheral V-groove 30 bounded at the front by a wall 31' defining a frustoconical recess 31 which accommodates part of the spray nozzle 3. The nozzle axis is trained onto the orbit of a set of apertures 32 formed in wall 31' near the bottom 30' of groove 30 which is partly occupied by the yarn 4. As the yarn is entrained by a transport mechanism not further illustrated, sheave 29 is rotated in synchronism therewith while being intermittently stained by a dyestuff penetrating the apertures 32. Excess dyestuff is exhausted via ports 33 in the inner peripheral housing wall to enter an annular channel 34 from which it is extracted under suction via a drain 35.

The separability of housing parts 2' and 2'' enables the insertion of yarn 4 into the groove 30 at the beginning of a dyeing operation.

In FIGS. 7 and 8 I have shown the sheave 29 of the preceding embodiment coaxially juxtaposed with a wheel 37 having radially projecting sectoral vanes 37' which are peripherally spaced apart by different distances according to the desired dyeing pattern. The access apertures in the front wall 31' of groove 30 (cf. FIG. 6) are here shown to include round bores 32' and slots 32'' on a radius extending into the cutouts between vanes 37'. The wheel body 37, 37' is of dished shape so as to fit with slight spacing into the frustoconical front recess 31 of sheave 29 where its vanes periodically interpose themselves between the nozzle 3 and the apertured groove wall. The groove bottom in this instance is shown to accommodate two yarns 4 next to each other which are simultaneously hit by the jet 8 from the nozzle whenever a cutout of wheel 37 registers with an aperture 32 or 32' aligned with the nozzle axis. Wheel 37 has a shaft 38 journaled in a tubular shaft 39 or sheave 29, the latter being driven by a motor 41 via a transmission belt 40; shaft 38 is driven directly by another motor 42. The two motors may be independently adjustable for varying the relative and absolute speeds of shutter members 29 and 37 though they could also be electrically coupled together for maintaining a predetermined relative speed of rotation. In any event, the motion of filaments 4 is synchronized with the rotation of sheave 29 whose drive motor 42 forms part of the yarn transport.

It will be apparent that two devices of the type shown in any of the preceding Figures may be cascaded with positive coupling of their respective drives to one another for multicolor dyeing. With two cascaded devices according to the embodiment of FIGS. 5 and 6, their sheaves 29 will automatically rotate at the same speed so that a twisted thread can be simulated by alternate spot-dyeing with different colors.

FIG. 9 shows a dyestuff-supplying system adapted to be used with any of the devices shown in FIGS. 1–8. This system comprises a recirculation pump 44, preferably operating under a pressure of 1 to 2.5 atmospheres gauge, feeding a supply conduit 43 via a filter 45. Conduit 43 merges at a junction 10' into the inlet duct 10 (cf. FIG. 2) of nozzle 3 confronting the associated shutter which is here shown by way of example as a perforated disk 5 similar to that of FIGS. 1 and 2. From the surrounding treatment chamber, omitted in this diagrammatic representation, excess liquid is exhausted by way of a drain pipe 51 into a fluid separator 50 which has a flue 50' for the escape of accompanying air into the atmosphere through a vent pipe 52. The separated liquid passes via a conduit 49 into a mixing or dosing vessel 48 having a further inlet 53 for fresh dyestuff from a nonillustrated reservoir, the admission of this dyestuff being controlled by a valve 54 responsive to a float-type level sensor 55 in vessel 48. The mixture of recirculated and newly added dyestuff is then returned to pump 44. A branch 43' of conduit 43 bypasses the nozzle inlet 10 and, via a manometer 46 and a pressure-reducing valve 47, returns some or all of the circulating liquid to the dosing vessel 48 when the flow to the orifice of nozzle 3 is throttled or blocked by its internal valve. With a plurality of cascaded space-dyeing devices according to my invention each device will of course be provided with an individual supply system of the kind shown in FIG. 9.

I claim:

1. A device for intermittently dyeing filamentary material, comprising:

a spray nozzle connected to a supply of liquid dyestuff under pressure;

transport means for continuously conveying a filament along a predetermined path past said nozzle; and shutter means interposed between said nozzle and said path for chopping a jet of dyestuff trained upon the latter by said nozzle, said shutter means including a dished wheel with radially projecting, peripherally spaced sectoral vanes mounted on a shaft for rotation about an axis thereof, said wheel having a concave side partly surrounding said nozzle.

2. A device for intermittently dyeing filamentary material, comprising:

a spray nozzle connected to a supply of liquid dyestuff under pressure;

transport means for continuously conveying a filament along a predetermined path past said nozzle; and shutter means interposed between said nozzle and said path for chopping a jet of dyestuff trained upon the latter by said nozzle, said shutter means including a sheave with a peripheral V-groove disposed in the path of said filament and mounted on a shaft for rotation about the axis thereof in synchronism with the advance of said filament, said sheave being provided with apertures in a wall of said V-groove close to the bottom thereof on an orbit intersected by the nozzle axis.

3. A device as defined in claim 1 wherein said wheel is coupled with said transport means for rotation in synchronism with the advance of said filament.

4. A device as defined in claim 2 wherein said wall forms a boundary of a frustoconical axial recess of said sheave partly surrounding said nozzle.

5. A device as defined in claim 4 wherein said shutter means further comprises a frustoconical wheel coaxial with said sheave having peripheral cutouts lodged in said recess between said nozzle and said wall, said wheel being provided with drive means for rotating same about the axis thereof but at a speed different from that of said sheave.

6. A device as defined in claim 2, 4 or 5 wherein said transport means comprises a motor coupled with a shaft of said sheave.

7. A device as defined in claim 2, further comprising a chamber surrounding said shutter means, at least part of said nozzle and a portion of a filament confronted thereby, said housing being provided with drain means for the evacuation of spent dyestuff.

8. A device as defined in claim 7 wherein said chamber forms part of a closed conduit system including a pump for the recirculation of spent dyestuff together with fresh dyestuff from said supply and dosing means for maintaining the total volume of circulating dyestuff substantially constant.

9. A device as defined in claim 8 wherein said conduit system has a branch downstream of said pump bypassing said nozzle, said branch being provided with a pressure-reducing valve.

10. A device as defined in claim 8 wherein said conduit system further includes a fluid separator provided with venting means between said drain means and said dosing means.

* * * * *